US005280495A

United States Patent [19]

Havas et al.

[11] Patent Number: 5,280,495

[45] Date of Patent: Jan. 18, 1994

[54] FURNACE REFRACTORY EXTRACTION SYSTEM AND METHOD

[75] Inventors: George Havas, Youngstown; Jose A. Garcia, Warren, both of Ohio

[73] Assignee: Ajax Magnethermic Corporation, Warren, Ohio

[21] Appl. No.: 835,666

[22] Filed: Feb. 14, 1992

[51] Int. Cl.[5] ..... H05B 6/22

[52] U.S. Cl. ..... 373/155; 373/122; 373/138; 373/151; 373/158; 432/3; 432/24

[58] Field of Search ..... 373/138, 151, 155, 156, 373/122, 71, 72, 75; 299/70, 72, 75; 266/281, 905, 276, 280; 110/336; 432/3, 24, 156-158, 241, 119, 248

[56] References Cited

U.S. PATENT DOCUMENTS

| | | | |
|---|---|---|---|
| 2,077,169 | 4/1937 | Green | 432/3 |
| 3,984,613 | 10/1976 | Reese | 432/156 |
| 4,277,638 | 7/1981 | Stenkvist | 373/108 |
| 4,334,857 | 6/1982 | Smitka et al. | 432/3 |
| 4,403,955 | 9/1983 | Sarno | 432/158 |
| 4,666,681 | 5/1987 | Ferrand et al. | 422/248 |
| 4,700,355 | 10/1987 | Guido | 373/72 |
| 4,755,137 | 7/1988 | Barbé et al. | 432/3 |

*Primary Examiner*—Bruce A. Reynolds
*Assistant Examiner*—Tu Hoang
*Attorney, Agent, or Firm*—Fay, Sharpe, Beall, Fagan, Minnich & McKee

[57] ABSTRACT

A furnace refractory extraction system and method includes a selectively removable bottom portion which is attached to a refractory extraction device associated with a container for drawing the refractory lining of a coreless induction furnace into the container. A plug portion in the furnace bottom is selectively removable to provide access to a bottom wall of the refractory lining. An opening is made in the bottom wall of the lining through which an extractor shaft is inserted and then attached to the removable bottom portion of the furnace bottom. The other end of the shaft is attached to a piston and cylinder assembly associated with the container at the open end of the furnace. When the piston and cylinder assembly is powered, the lining is drawn into the container.

18 Claims, 4 Drawing Sheets

FURNACE REFRACTORY EXTRACTION SYSTEM AND METHOD

BACKGROUND OF THE INVENTION

This invention pertains to the art of coreless induction furnaces such as those that contain a replaceable refractory hearth lining, and more particularly to a method and system for extracting the lining from the furnace.

The invention is particularly applicable to an induction melting furnace in which a furnace content to be heated is supported in a refractory hearth. Sometimes the lining material itself or the furnace content may be dangerous or harmful so that when it is necessary to replace the refractory lining, the lining should be contained for transport and ultimate disposal. The invention is particularly applicable to a method and system for extracting such a lining from the furnace and placement in a container for transport, storage or ultimate disposal. However, it will be appreciated by those skilled in the art that the invention could be readily adapted for use in other environments as, for example, where cumbersome and potentially harmful linings are to be replaced and contained upon extraction from a furnace or other device.

Refractory linings that are employed as hearths useful for such induction melting furnaces are typically composed of fire-proof materials commonly referred to as dry ram type refractories such as silica, alumina or magnesia. The linings have to be replaced at regular intervals so the safety, convenience and efficiency of the replacement process are important considerations. In particular, where the furnace work content is a dangerous and harmful item, such as one that has been radioactively contaminated, minimal safety precautions require containment of the refractory lining during both extraction of the lining from the furnace and subsequent transport, storage and disposal.

Prior known systems for refractory extraction and discharge have met with varying degrees of success. Such systems and methods have included lifting the refractory lining by means of a crane from the furnace cavity, dismantling of the furnace floor so that the lining can be pushed out or breaking up of the refractory lining with pneumatic hammers. U.S. Pat. No. 4,334,857 discloses a method and system where a push-out device, acting underneath the furnace floor, pushes out the furnace lining upon cooling of the lining so that a separation occurs between the furnace sidewalls and the lining.

None of the foregoing prior art systems are useful with regard to the controlled extraction and containment of a dangerous lining material or a lining which has been contaminated by a harmful furnace content. All the methods will involve uncontained extraction and/or breaking up of the crucible. Also, the ejection device of the '857 patent involves a substantial modification of a furnace floor which is undesirable from the standpoint of furnace construction.

The present invention contemplates a new and improved refractory extraction system and method which overcomes the above problems and provides improved safety and economy of construction and yet is simple in design so that refractory replacement can be easily accomplished while safe containment of a contaminated lining is maintained.

BRIEF SUMMARY OF THE INVENTION

In accordance with the present invention there is provided a furnace refractory extraction assembly including a coreless induction furnace having a selectively removable bottom portion. A refractory hearth lining is disposed within the furnace coils and has a bottom wall adjacent the removable bottom portion. A refractory extraction device is provided and includes an extractor shaft which can be attached to the removable bottom portion by insertion through the bottom wall of the refractory lining. The extraction device includes a piston and cylinder assembly to draw the bottom portion through the furnace whereby the refractory lining can be extracted from the furnace cavity. During normal operation, the extraction device is not used and a replaceable refractory plug is employed to assist in support of the refractory lining.

In accordance with another aspect of the present invention, a container is disposed to receive the refractory lining upon extraction from the furnace. The container is clamped to the furnace during extraction. At the time of lining replacement, the refractory plug is removed to provide access to the bottom wall of the lining so that an opening can be made therethrough. The extractor shaft is then attached to the removable bottom portion. The other end of the extractor shaft is secured to the piston and cylinder assembly which, in turn, can draw the lining into the container.

One benefit obtained by use of the present invention is an extraction system and method which can draw a refractory lining through a coreless induction furnace into a containment device.

Another benefit obtained from the invention is a system and method for removing the lining from the furnace that involves minimal modification of a conventional coreless induction furnace bottom.

A further benefit of the present invention is an extraction system and method that can be used for extraction and containment of a number of contaminated linings.

Other benefits and advantages for the subject invention will become apparent to those skilled in the art upon a reading and understanding of this specification.

BRIEF DESCRIPTION OF THE DRAWINGS

The invention may take physical form in certain parts and steps and arrangements of parts and steps, the preferred embodiments of which will be described in detail in the specification and illustrated in the accompanying drawings which form a part hereof and wherein.

DETAILED DESCRIPTION OF THE INVENTION

Figure 1:
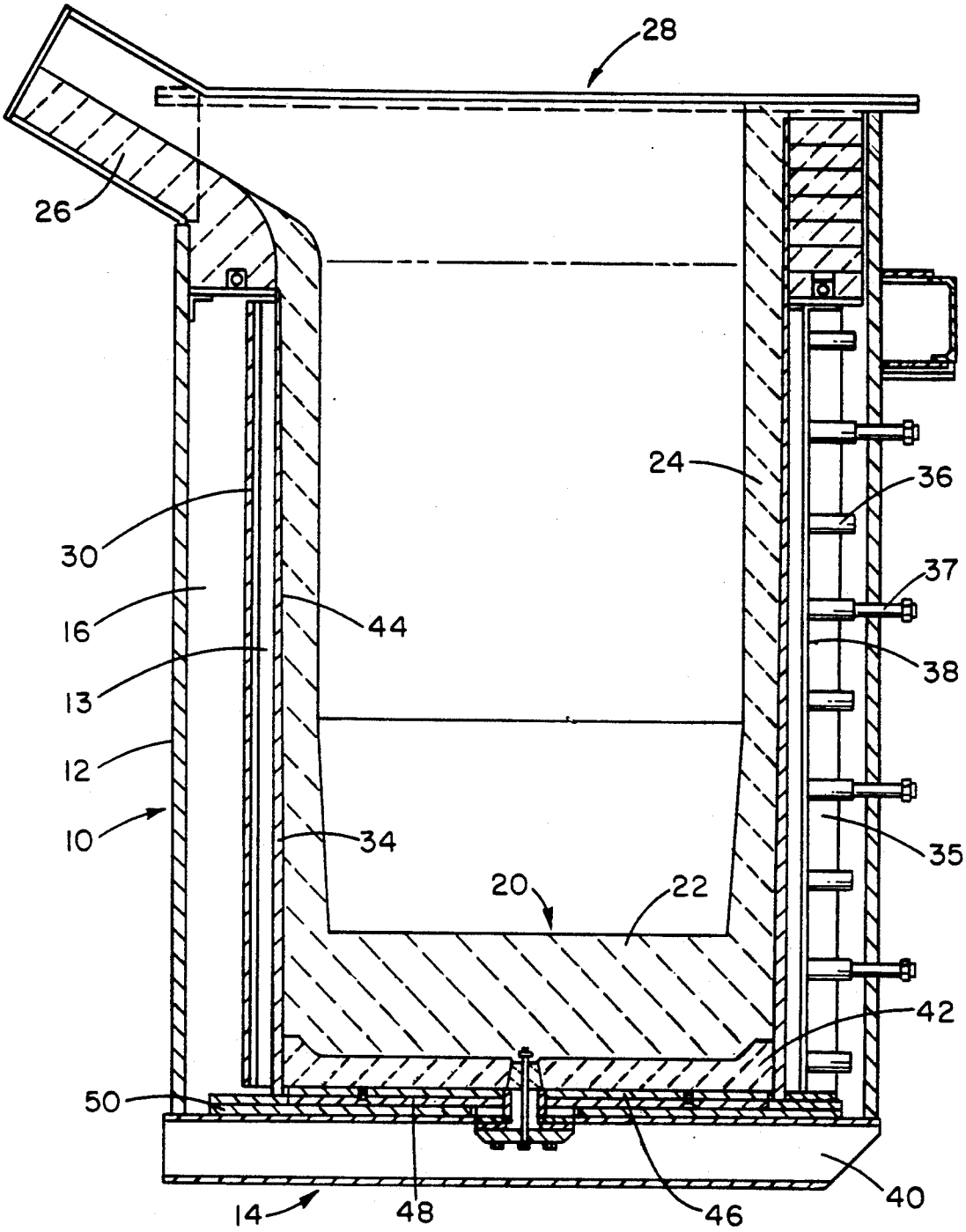
FIG. 1 is a cross-sectional view of a coreless induction furnace for normal operation formed in accordance with the present invention.

Referring now to the drawings wherein the showings are for purposes of illustrating the preferred embodiments of the invention only, and not for purposes of limiting same, the FIGURES show a coreless induction furnace 10 having steel shell sidewalls 12 in which are disposed a plurality of induction heating coils 13 spaced from the sidewalls 12 by an air gap 16, and a furnace bottom 14. Disposed within the furnace cavity is a refractory lining 20, preferably comprised of a dry ram type of refractory material such as silica, alumina, or magnesia. The lining 20 includes a bottom wall 22, sidewall 24, and a spout 26 at the furnace open end 28. The inner wall of the lining, referred to as the "hot face", is sintered, but the refractory material becomes looser and more granular as it moves away from the hot face. The outer sidewall of the lining engages a tapered grout layer 34 which with a layer of insulating material 44 forms a slip plane so that the lining 20 nests within the furnace in a manner that facilitates ease of removal. The furnace power coils 13 are supported by stud boards 30 and a conventional yoke assembly including a yoke 35, clamps 36 and bolts 37. The yoke assembly is insulated from the coils by an insulating layer 38.

The furnace bottom is comprised of an assembly of several elements which are supported by a plurality of beams 40. It is a particular feature of the invention that a portion of the furnace bottom is separable and removable so that it can be withdrawn from the furnace bottom 14 toward the furnace open end 28 to cause the refractory lining 20 to be drawn through the furnace cavity. The bottom wall 22 of the refractory lining is adjacent to a cast bottom 42 of hard refractory material. The bottom wall 22 has a generally annular configuration and is sized to extend radially to immediately adjacent the layer slip plane 44 to provide a wide and evenly distributed support for the lining bottom wall 22. Adjacent the cast bottom 42 is annular plate 46, preferably aluminum, and steel plate 48. The aluminum plate 46 interrupts magnetic fields to the steel plate 48, which provides support for the cast bottom 42, particularly during its removal. The cast bottom 42 and plates 46, 48 comprise the removable portion of the furnace bottom which can be drawn towards the furnace open end to remove the refractory lining as will hereinafter be more fully explained.

Figure 3:
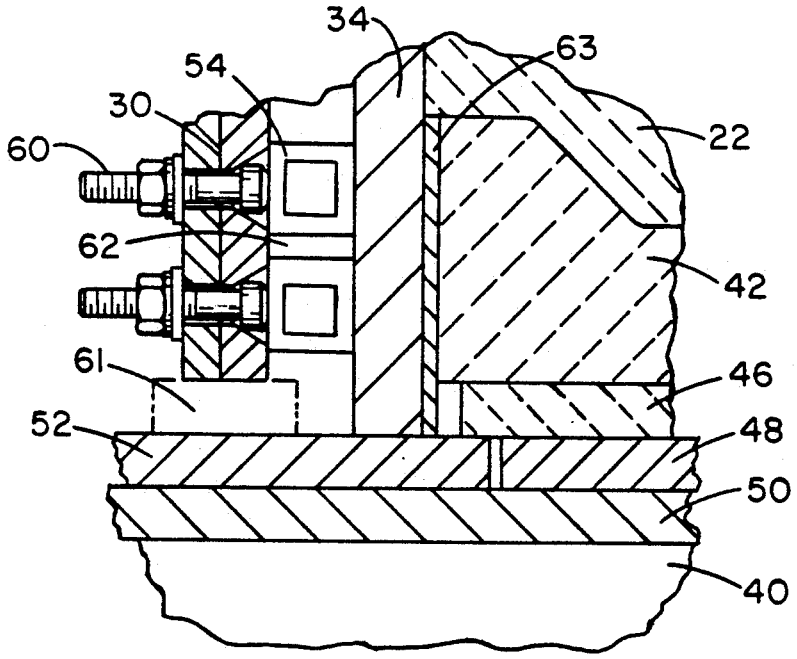
FIG. 3 is an enlarged cross-sectional view of another portion of the furnace bottom of FIG. 1, particularly illustrating the support of the furnace bottom at the sidewall of the furnace.

With reference to FIG. 3, it can be seen that the removable furnace bottom portion is supported by a bottom cover steel plate 50 . Another aluminum ring 52 also interrupts the magnetic fields to the plate 50. The coil turns 54 are supported by the stud boards 30 and stud bolts 60 which rest on an insulated block spacer 61. The coil turns 54 are spaced by gaps such as at 62 which are usually filled with grout. The gaps 63 between cast bottom 42 and grout layer 34 are typically also filled with refractory material at the time of assembly.

Much of the above-described elements are conventional in assembly and configuration to accomplish an object and benefit of the invention that the subject furnace is intended to involve minimal structural modification of a conventional coreless induction furnace bottom. However, with reference to FIG. 2, a distinction can be seen in that the cast bottom 42 includes an opening 64 in the shape of a truncated cone to receive a refractory plug 66 therein which is matingly tapered to nest in the cast bottom 42. Over the plug 66 is a grout filler 69 of a refractory material, such as alumina plastic, to fill voids.

The assembly for securing the plug 66 to the furnace bottom comprises an annular collar or pin guide 70, which abuts the plug 66 at its end 72. The pin guide 70 is, in turn, secured to the steel plate 48 by fasteners 74. A plate 76 covers the plug and pin guide 70. An annular spacer 78 is preferably employed to properly position the pin guide 70 relative to the steel plate 48. A bolt 82 is disposed through the plug 66 and plate 76 and is a part of the furnace ground detection system with wire connection 84.

It can be appreciated that except for the opening 64 and the plug 66 and its associated support assembly, the furnace bottom would appear to a furnace operator to be very similar to a conventional furnace lacking the special refractory extraction system of the present invention.

Figure 4:
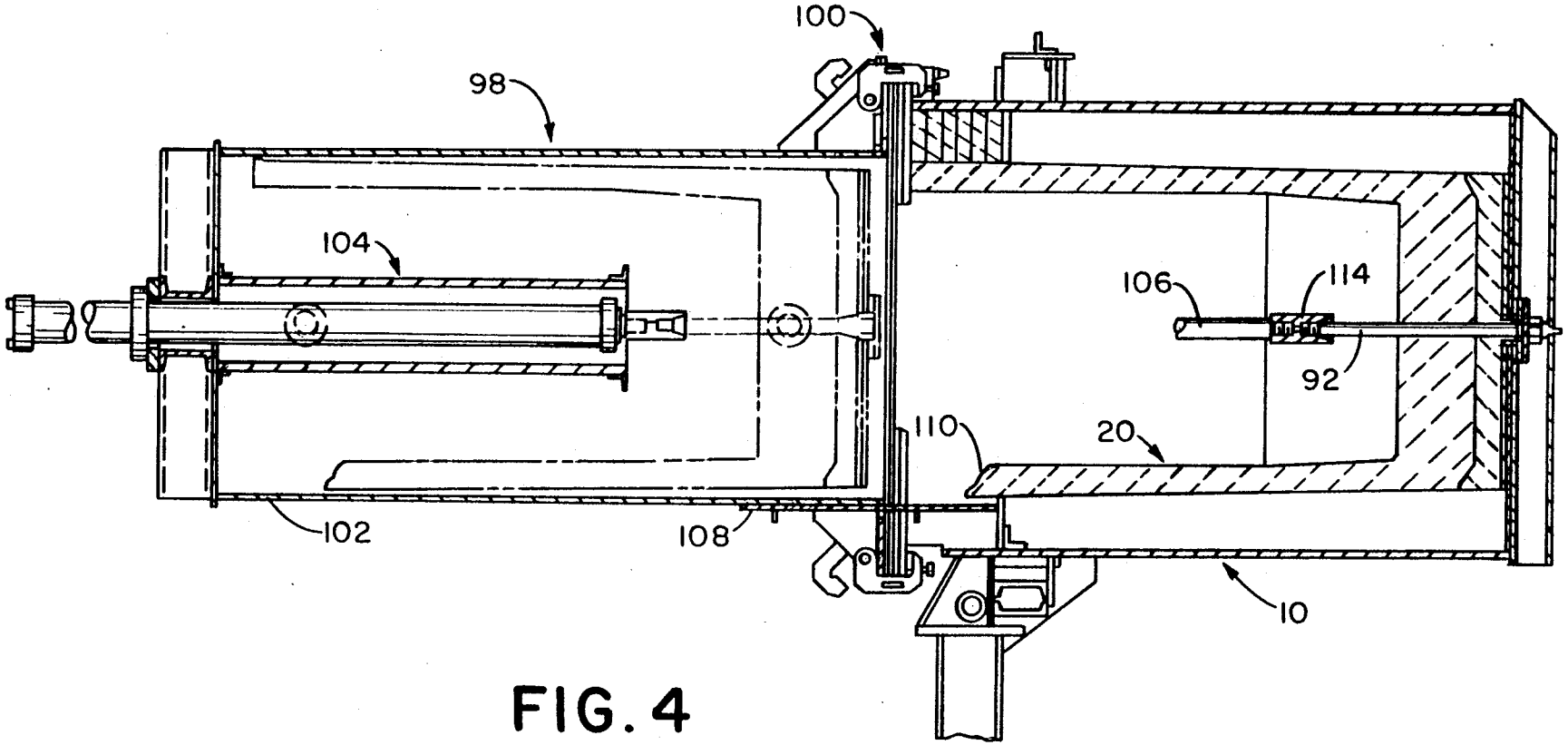
FIG. 4 is a cross-sectional view of the furnace showing a container associated with the furnace open end and including an extraction device for drawing the refractory lining into the container wherein the refractory lining is shown in dotted line when positioned within the container.
Figure 5:
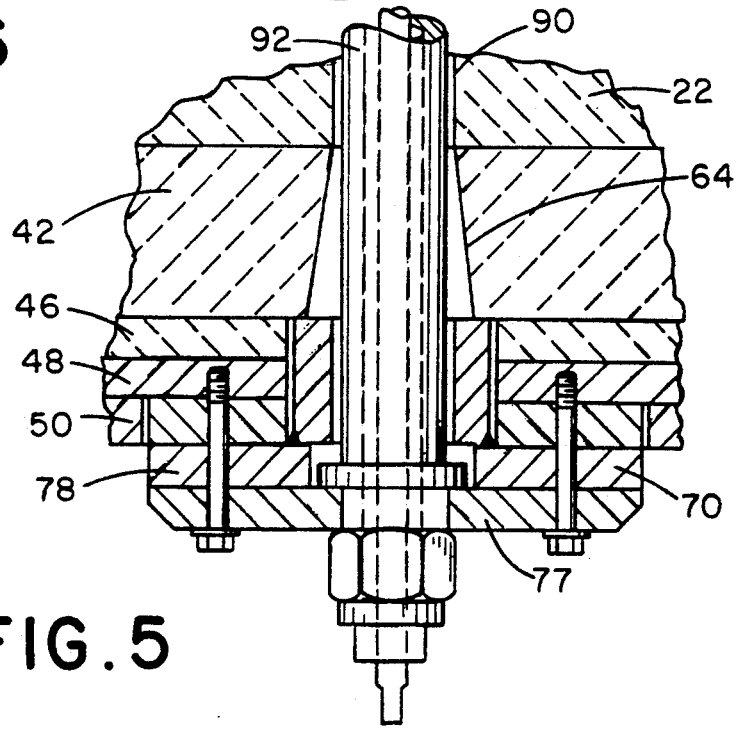
FIG. 5 is an enlarged cross-sectional view particularly showing the assembly of an extractor shaft associated with the container and the removable furnace bottom portion.

With particular reference to FIGS. 4 and 5, the special extractor system of the present invention will be more fully explained. The extraction system provides a means for removing the refractory hearth lining quickly, easily and as free of the normal dusty and dirty atmosphere normally associated with lining removal as possible for a safer containment operation.

Figure 2:
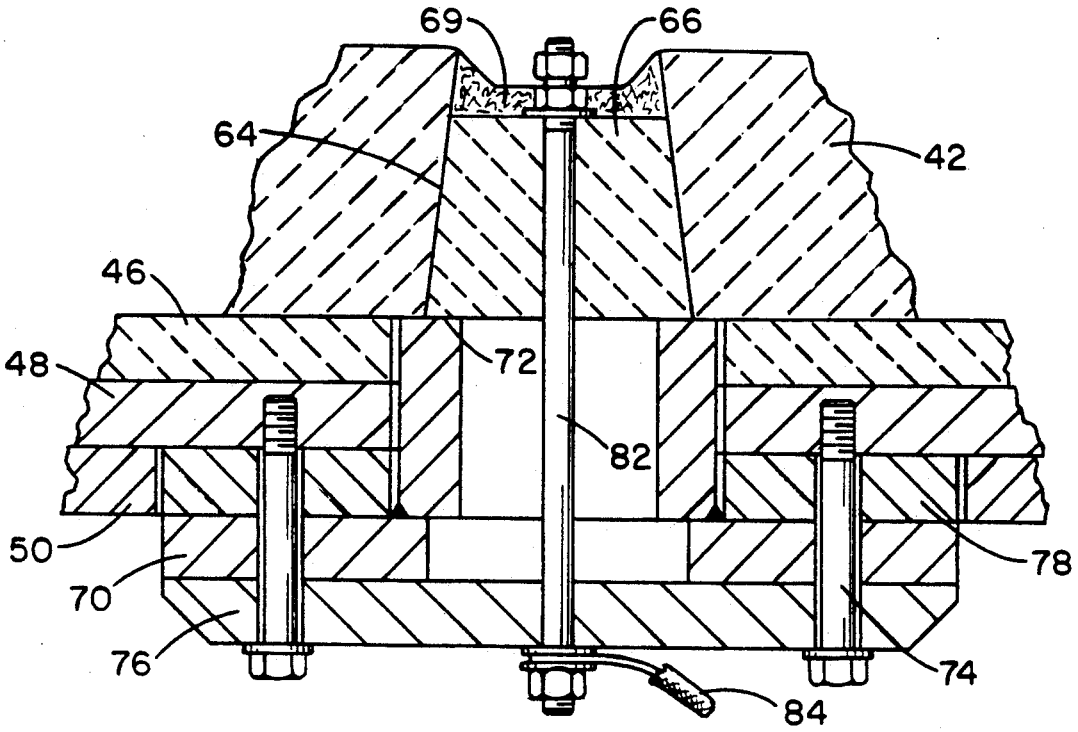
FIG. 2 is an enlarged cross-sectional view of a portion of the furnace bottom of FIG. 1, particularly illustrating a refractory plug used in the furnace bottom during normal furnace operation.

As shown in FIG. 4, the spout 26 (FIG. 1) is removed. Although apparently illustrated as rotated 90°, the furnace can be disposed in its normally upstanding position or rotated on its side as shown since the extraction system can be successfully employed in either case, or in any desired position. The refractory plug 66 and its support assembly has also been removed by loosening the fasteners 74 and one of the nuts holding the ground bolt 82 in place (FIG. 2). After removal of the plug 66, the pin guide 70 is refastened to the steel plate 48 (FIG. 5) along with new cover 77. The lining bottom wall 22 is now accessible through the cast bottom opening 64. An opening 90 is preferably drilled through the hearth refractory bottom wall 22 to accommodate an extractor shaft 92. Next, a lining extraction assembly 98 (FIG. 4) can be mounted on the furnace with conventional locking clamps and locator pin assemblies 100. The extraction device 98 essentially comprises a container 102 and a hydraulically powered piston and cylinder assembly 104 which has a rod 106 sized so that it can be extended into the furnace cavity and be secured to the extractor shaft 92. A spout closure chute 108 is disposed at the periphery of the container 102 and is lowered toward the furnace 10 to cover the refractory lining 20 at its end portion 110. Set screws (not shown) can be employed to tighten and hold the chute in proper position. The rod 106 is next extended its maximum length toward the extractor shaft 92. The shaft 92 is pressed through the bottom wall opening 90 until it centers with the rod so that it can be located and locked in the coupling 114. The shaft 92 is then threadedly secured to the coupling 114. It will be seen with particular reference to FIG. 5 that the shaft comprises a tube 116 and inner rod 118. Both of these elements are secured in the coupling 114, and then a nut is used to secure the other end of the shaft 92 to the steel plate 77, pin guide 70, spacer 78, steel plate 48 and aluminum plate 46. The entire assembly is next ready to be drawn from the furnace cavity to urge the lining 20 into the container 102.

As can be seen with reference to FIG. 4, the container is shown holding the lining 20 and removable first bottom portion in dashed line. After the lining is fully drawn into the container, the hydraulics to the piston and cylinder assembly can be withdrawn, the container can be unclamped from the furnace and the lining can be removed to an appropriate disposal bin. While most of the lining will be removed by the extraction assembly 98, some of the loose backup will remain in the bottom of the furnace and will have to be raked and/or vacuumed out into a bin before a relining of the furnace can take place.

Figure 6:
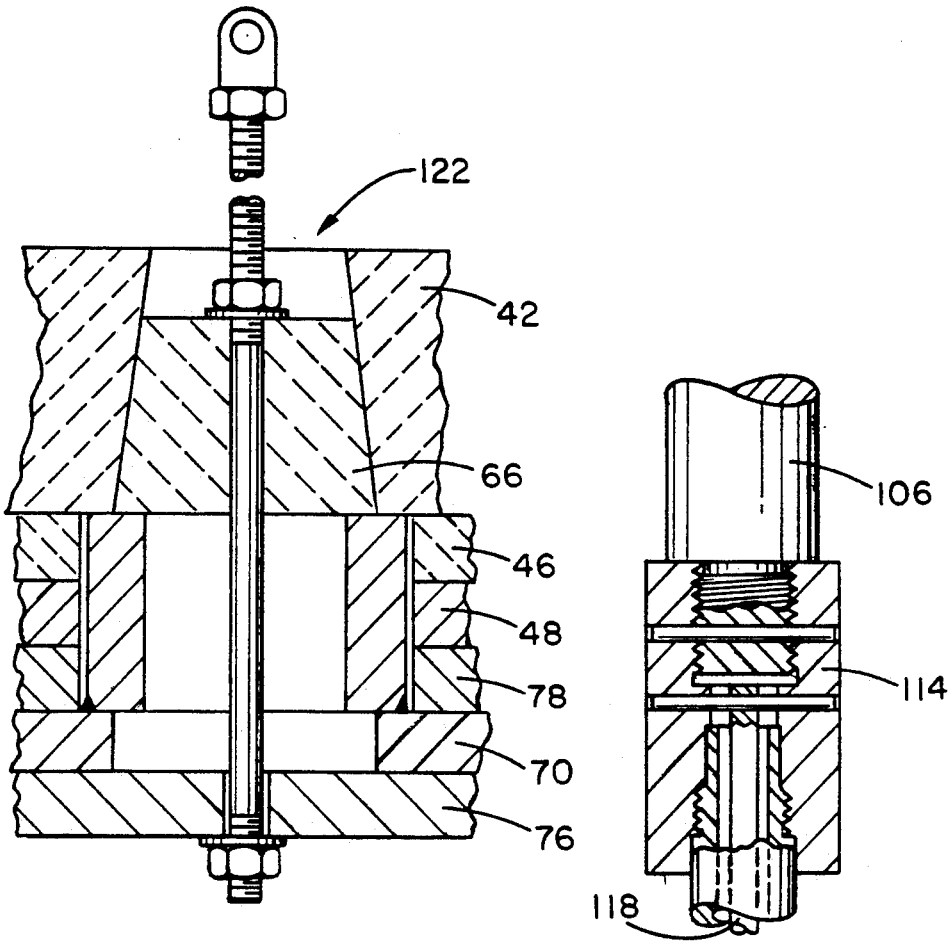
FIG. 6 is an enlarged cross-sectional view of the portion of the furnace bottom as assembled for lowering a new lining into the furnace.

After disposal of the lining 20, the removable bottom portion comprising plates 46, 48, pin guide 70, annular space 78, plate 76, and plug 66 can be lowered back into the furnace cavity by the lifting guide and threaded rod assembly 122 (FIG. 6). After insertion, a new lining can be disposed in the furnace cavity and the furnace can be returned to normal operation.

It is a feature of the invention that with the use of the hydraulic piston and cylinder assembly associated with the container, the refractory lining can be drawn into the container without a need for substantially changing the furnace bottom to accommodate a permanent ejection device.

Although a piston and cylinder assembly is shown, it is within the scope of the invention to employ other means for lifting the lining such as a hoist or winch. Also, the advantageous lifting action and structure could be employed without a container where lining containment is not necessary. The illustrations show a lifting action on the lining from above relative to the furnace bottom. It should be kept in mind that where the furnace is not upstanding, the "lifting" need not be in an upward direction, but rather only in a direction from above or opposite of the furnace bottom.

The invention has been described with reference to preferred embodiments. Obviously, modifications and alterations will occur to others upon the reading and understanding of the specification. It is our intention to include all such modifications and alterations in so far as they come within the scope of the appended claims or the equivalents thereof.

Having thus described our invention, we now claim:

1. A furnace refractory extraction apparatus for a furnace including (1) a selectively removable bottom portion, and (2) a refractory lining disposed within the furnace and supported by the bottom portion and having a bottom wall adjacent the bottom portion; comprising:

a refractory extraction device located above the bottom wall and including an extractor shaft selectively disposable through the bottom wall; and, means for actuating the refractory extraction device to draw the bottom portion through the furnace whereby the refractory lining is selectively extracted therefrom.

2. The extraction apparatus of claim 1 including a container disposed to receive the refractory lining upon extraction from the furnace.

3. The extraction apparatus of claim 2 including means for locating and clamping the container to the furnace.

4. The extraction apparatus of claim 1 wherein the means for actuating comprises a piston and cylinder assembly.

5. The extraction apparatus of claim 4 wherein the refractory extraction device includes means for locating and locking the extractor shaft to the piston and cylinder assembly.

6. The extraction apparatus of claim 1 wherein the bottom portion includes a selectively removable refractory plug for additional support of the refractory lining during furnace operations prior to actuating the refractory extraction device.

7. The extraction apparatus of claim 6 including means for selectively attaching the refractory extraction device to the selectively removable bottom portion.

8. The extraction apparatus of claim 1 wherein the refractory lining is tapered whereby the lining nests in the furnace until urged away from the furnace by the refractory extraction device.

9. The extraction apparatus of claim 1 wherein the means for actuating is associated with a container to receive the refractory lining upon extraction.

10. An extraction assembly for a refractory lining of a crucible furnace having an open end, a coil and a floor:

wherein the refractory lining has a side wall and a bottom wall sized for close reception adjacent the coil and floor to form a crucible therein; and means for urging the lining into a containment device selectively disposed above the bottom wall at the open end to receive the refractory lining upon being urged from the furnace.

11. The extraction assembly of claim 10 wherein the containment device includes means for locking the containment device to the crucible furnace.

12. The extraction assembly of claim 10 wherein the means for urging is fixed to the containment device and the refractory lining is selectively separable from the crucible furnace.

13. The extraction assembly of claim 12 wherein the means for urging includes an extractor shaft projected through the bottom wall and attached at an end portion to a removable portion of the floor.

14. The extraction assembly of claim 13 wherein the means for urging further includes a piston and cylinder assembly associated with the containment device and attached to the extractor shaft at an other end portion whereby upon powering of the piston and cylinder assembly the extractor shaft and the removable portion of the furnace floor are drawn from the furnace.

15. The extraction assembly of claim 13 wherein the removable portion of the floor is sized to match the bottom wall for distributed support of the bottom wall and side wall during extraction.

16. A method of extracting a refractory lining from a furnace into a containment device wherein the furnace has an open end, a bottom and a selectively separable bottom portion, the lining has a bottom wall supported by the selectively separable bottom portion, and the containment device includes a lifting assembly disposed above the bottom wall to be secured to the selectively separable bottom portion, the method comprising steps of:

removing a plug disposed in the furnace bottom to provide access to the lining bottom wall from below the bottom of the furnace;

making an opening through the bottom wall at a former position of the plug;

inserting an extractor shaft through the opening;

securing a first end of the extractor shaft to the lifting assembly;

attaching a second end of the extractor shaft to the selectively separable bottom portion;

powering the lifting assembly to draw the extractor shaft, the bottom portion and the lining from the furnace into the containment device.

17. A method of extracting and replacing a refractory lining for a furnace comprising steps of:

disposing a container over the furnace at a furnace open end;

urging the lining into the container;

separating the container from the furnace and disposing the container at a position spaced from the furnace; and, placing a new lining in the furnace.

18. A method of extracting a refractory lining from a furnace wherein the furnace has an open end, a bottom and a selectively separable bottom portion, the refractory lining has a bottom wall supported by the selectively separable bottom portion, and a lifting assembly is disposed to be secured to the selectively separable bottom portion, the method comprising steps of:

removing a plug disposed in the furnace bottom to provide access to the lining bottom wall from below the bottom of the furnace;

making an opening through the bottom wall at a former position of the plug;

inserting an extractor shaft through the opening;

securing a first end of the extractor shaft to the lifting assembly;

attaching a second end of the extractor shaft to the selectively separable bottom portion;

powering the lifting assembly to draw the extractor shaft, the bottom portion and the lining from the furnace.

* * * * *